US005480369A

United States Patent [19]

Dudley

[11] Patent Number: 5,480,369

[45] Date of Patent: Jan. 2, 1996

[54] RESILIENT EXERCISE DEVICE WHEREIN USER'S LEGS PROVIDE A COUNTER FORCE TO EXERCISE OF USER'S ARMS

[76] Inventor: Randall W. Dudley, 12653 Adobe Rd., Bakersfield, Calif. 93307

[21] Appl. No.: 285,168

[22] Filed: Aug. 3, 1994

[51] Int. Cl.[6] ..... A63B 21/02

[52] U.S. Cl. ..... 482/125; 482/123; 482/130

[58] Field of Search ..... 482/121, 122, 482/123, 125, 129, 130, 907

[56] References Cited

U.S. PATENT DOCUMENTS 5,112,287 5/1992 Brewer ..... 482/130

5,125,649 6/1992 Fuller ..... 482/123

5,269,737 12/1993 Sobotka ..... 482/130

*Primary Examiner*—Lynne A. Reichard

[57] ABSTRACT

A new and improved flex center with a standing plate having two side walls and two base walls. Two extension brackets are secured to the standing plate. Each of the two brackets has a threaded aperture therethrough. Two lower L-shaped extensions are secured to the two extension brackets. Two elastic bands are secured to one of the corresponding two lower L-shaped extensions. Also, a shoulder bar has two off-set ends and an intermediate extent therebetween. Each of the two off-set ends has an upper L-shaped extension securely thereon. Each of the upper L-shaped extensions are secured to the corresponding two elastic bands.

1 Claim, 4 Drawing Sheets

RESILIENT EXERCISE DEVICE WHEREIN USER' S LEGS PROVIDE A COUNTER FORCE TO EXERCISE OF USER' S ARMS

BACKGROUND OF THE INVENTION

1. Field of the Invention

The present invention relates to a flex center and more particularly pertains to exercising with the aid of rubber bands with a flex center.

2. Description of the Prior Art

The use of exercise apparatuses is known in the prior art. More specifically, exercise apparatuses heretofore devised and utilized for the purpose of exercising are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,125,649 to Fuller discloses an exercise apparatus utilizing a booster bar and shock cords.

U.S. Pat. No. 5,029,850 to van Straaten discloses an exercising apparatus with elastic bands between anchor points on a bottom bar and pulleys on a top bar.

U.S. Pat. No. 5,197,934 to Wirtz discloses an elastic exercise device.

U.S. Pat. No. 5,160,303 to Smith discloses an elastic resistance exercise device having resistance element retaining structure.

U.S. Pat. No. 3,785,645 to Yosef discloses an elastic band type exercising device.

U.S. Pat. No. 3,620,530 to Cosby discloses an elastic band-resistance exercising device.

While these devices fulfill their respective, particular objective and requirements, the aforementioned patents do not describe a flex center that utilizes exercising with the aid of rubber bands.

In this respect, the flex center according to the present invention substantially departs from the conventional concepts and designs of the prior art, and in doing so provides an apparatus primarily developed for the purpose of exercising with the aid of rubber bands.

Therefore, it can be appreciated that there exists a continuing need for a new and improved flex center which can be used for exercising with the aid of rubber bands. In this regard, the present invention substantially fulfills this need.

SUMMARY OF THE INVENTION

In the view of the foregoing disadvantages inherent in the known types of exercise apparatuses now present in the prior art, the present invention provides an improved flex center. As such, the general purpose of the present invention, which will be described subsequently in greater detail, is to provide a new and improved flex center and method which has all the advantages of the prior art and none of the disadvantages.

To attain this, the present invention essentially comprises a standing plate having a rectangular and flat configuration. The plate has two side walls and two base walls. The device contains two extension brackets. Each of the two brackets has an upper end and a lower end. The two brackets are perpendicularly secured to the standing plate with each of the two brackets diametrically opposed and adjacent the two side walls of the standing plate. Each of the two brackets has a threaded aperture therethrough. The device contains two lower L-shaped extensions. Each extension has a first end and a second end. Each first end is secured to the upper end of the two extension brackets. The device contains two U-shaped bar rest receivers. Each receiver has an upper surface and a lower surface. Each lower surface is secured to the two lower L-shaped extensions. A foot bar is removably secured within the two apertures formed in the threaded apertures of the two extension brackets. The device contains two elastic bands. Each band has a first end with an aperture, a second end with an aperture, and an intermediate extent therebetween with an oblong aperture therein. Each first end is secured to a corresponding second end of the two lower L-shaped extensions. The device contains a shoulder bar having a two off-set ends and an intermediate extent therebetween. Each of the two off-set ends has an upper L-shaped extension securely thereon. Each of the upper L-shaped extensions is secured to the corresponding second end of the two elastic bands. The two off-set ends form handgrips. A padded element is secured to the intermediate extent. The shoulder bar is received in the upper surface of the two U-shaped bar rest receivers when not in use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flex center which has all the advantages of the prior art exercise apparatuses and none of the disadvantages.

It is another object of the present invention to provide a new and improved flex center which may be easily and efficiently manufactured and marketed.

It is a further object of the present invention to provide a new and improved flex center which is of durable and reliable construction.

An even further object of the present invention is to provide a new and improved flex center which is susceptible of a low cost of manufacture with regard to both materials and labor, and which accordingly is then susceptible of low prices of sale to the consuming public, thereby making such a flex center economically available to the buying public.

Still yet another object of the present invention is to provide a new and improved flex center which provides in the apparatuses and methods of the prior art some of the advantages thereof, while simultaneously overcoming some of the disadvantages normally associated therewith.

Even still another object of the present invention is to provide a new and improved flex center for exercising with the aid of rubber bands.

Lastly, it is an object of the present invention to provide a new and improved flex center with a standing plate having two side walls and two base walls. Two extension brackets are secured to the standing plate. Each of the two brackets has a threaded aperture therethrough. Two lower L-shaped extensions are secured to the two extension brackets. Two elastic bands are secured to one of the corresponding two lower L-shaped extensions. Also, a shoulder bar has two off-set ends and an intermediate extent therebetween. Each of the two off-set ends has an upper L-shaped extension securely thereon. Each of the upper L-shaped extensions are secured to the corresponding two elastic bands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
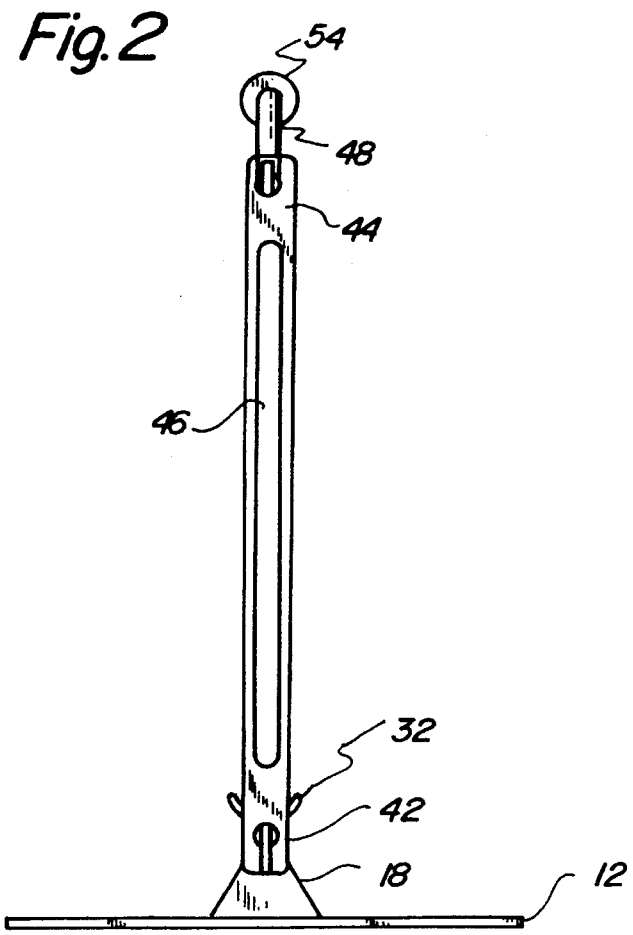
FIG. 2 is a side view of the present invention.
Figure 1:
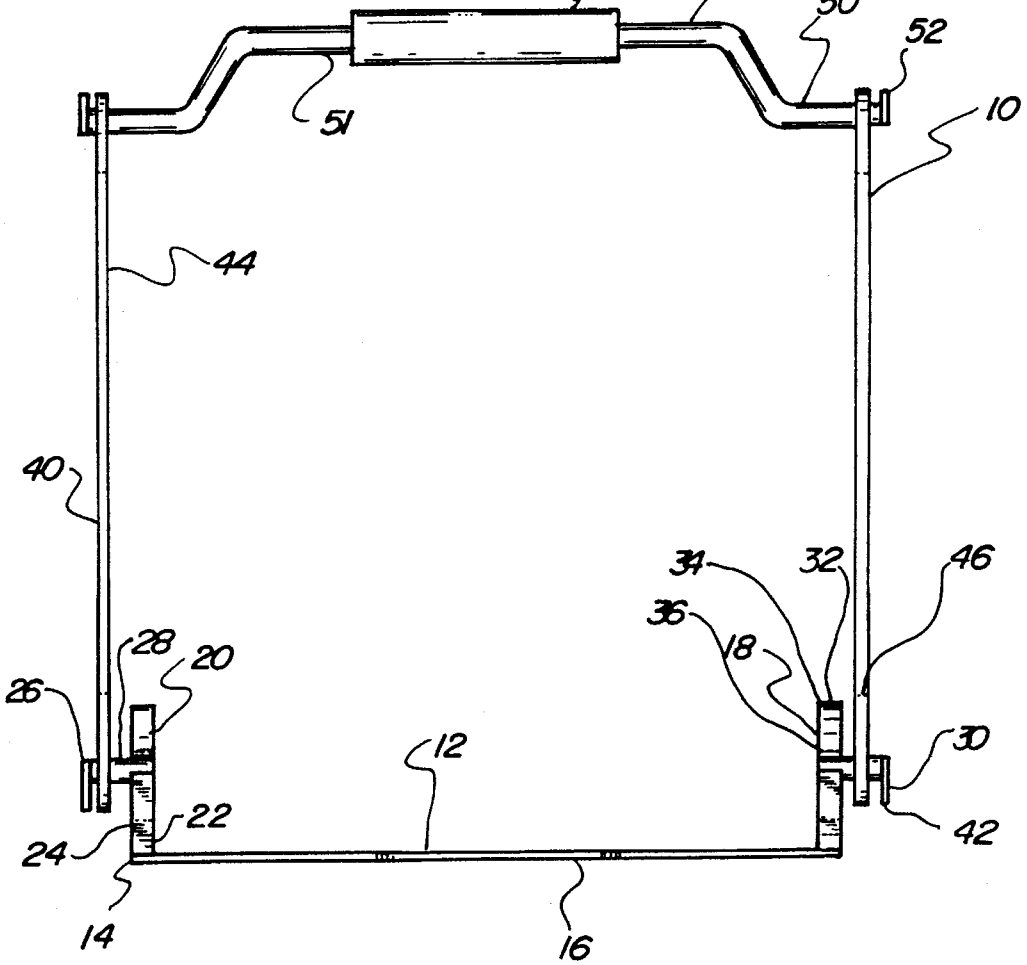
FIG. 1 is a perspective view of the preferred embodiment of the flex center constructed in accordance with the principles of the present invention.
Figure 4:
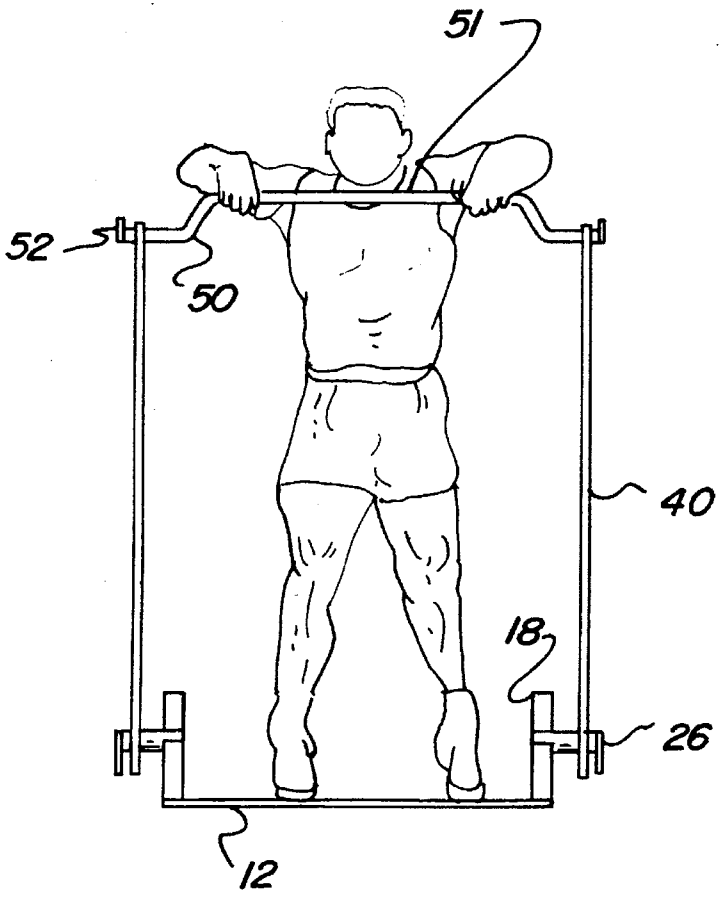
FIG. 4 is a front view of the present invention displaying another of its capabilities.
Figure 3:
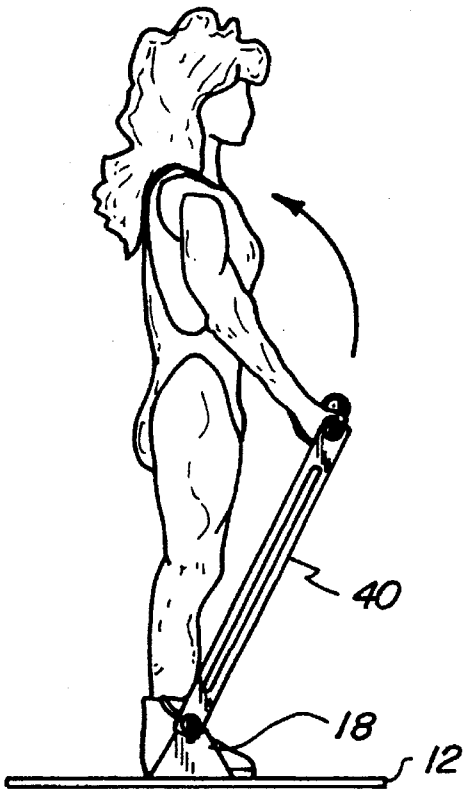
FIG. 3 is a side view of the present invention displaying one of its capabilities.
Figure 5:
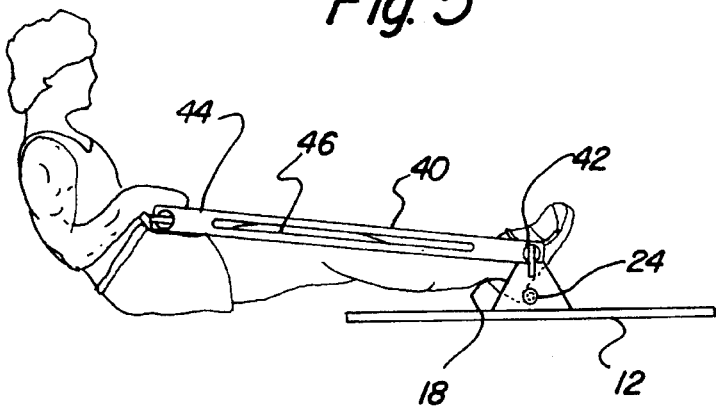
FIG. 5 is a side view of the present invention displaying yet another capability.
Figure 6:
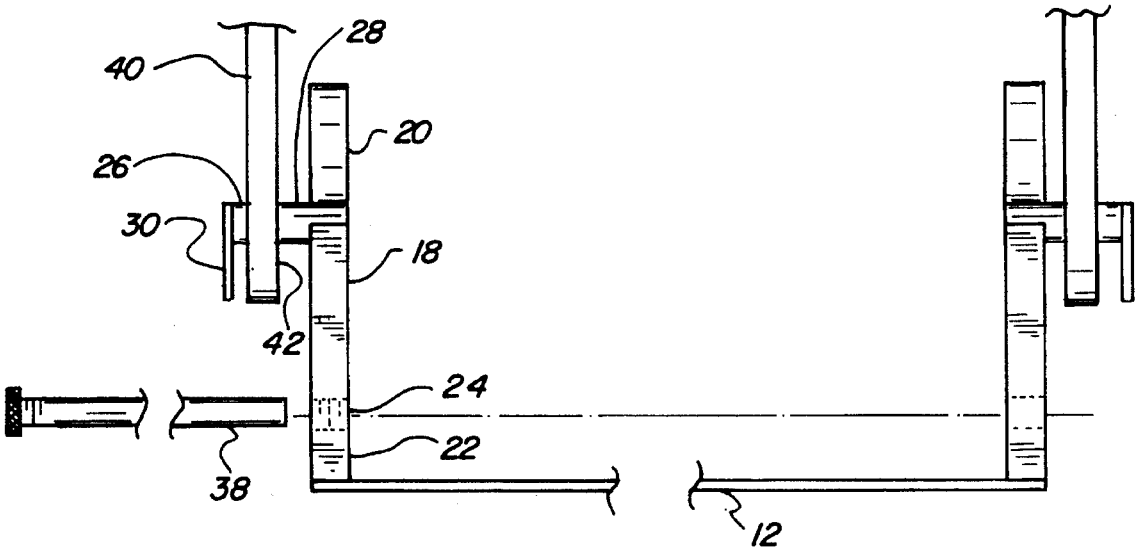
FIG. 6 is an enlarged partial view of the application of the foot bar.
Figure 7:
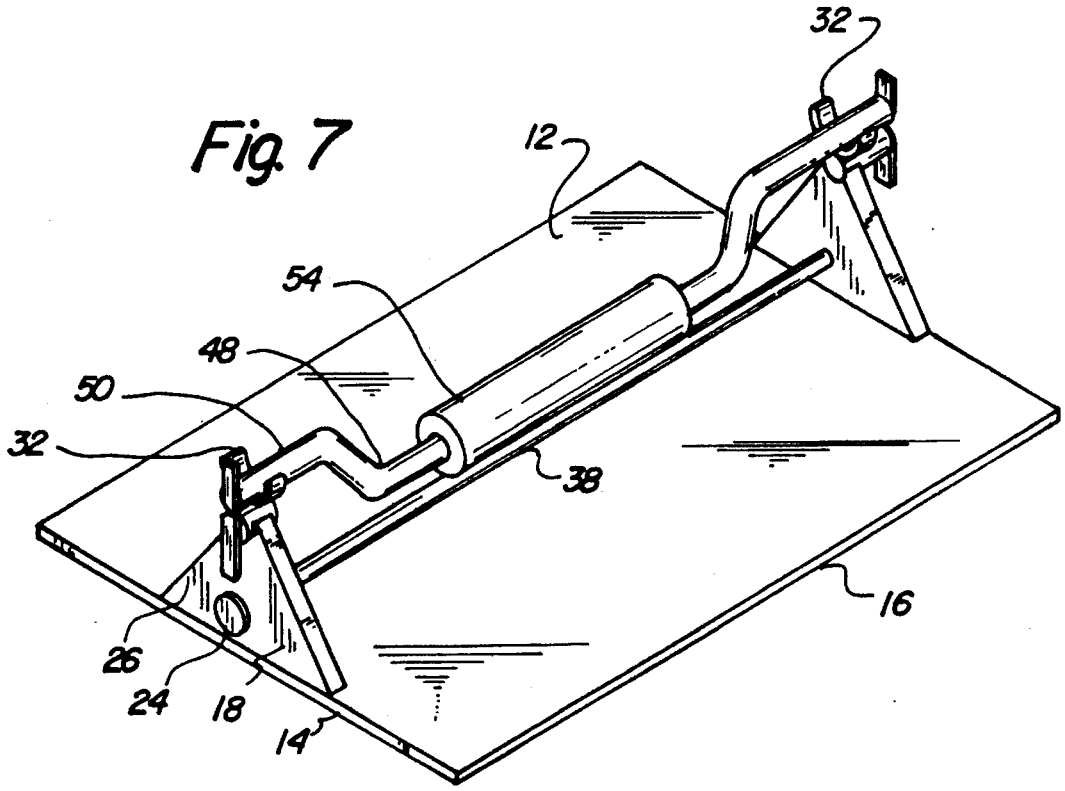
FIG. 7 is a perspective view of the present invention without the elastic bands for storage purposes.
Figure 8:
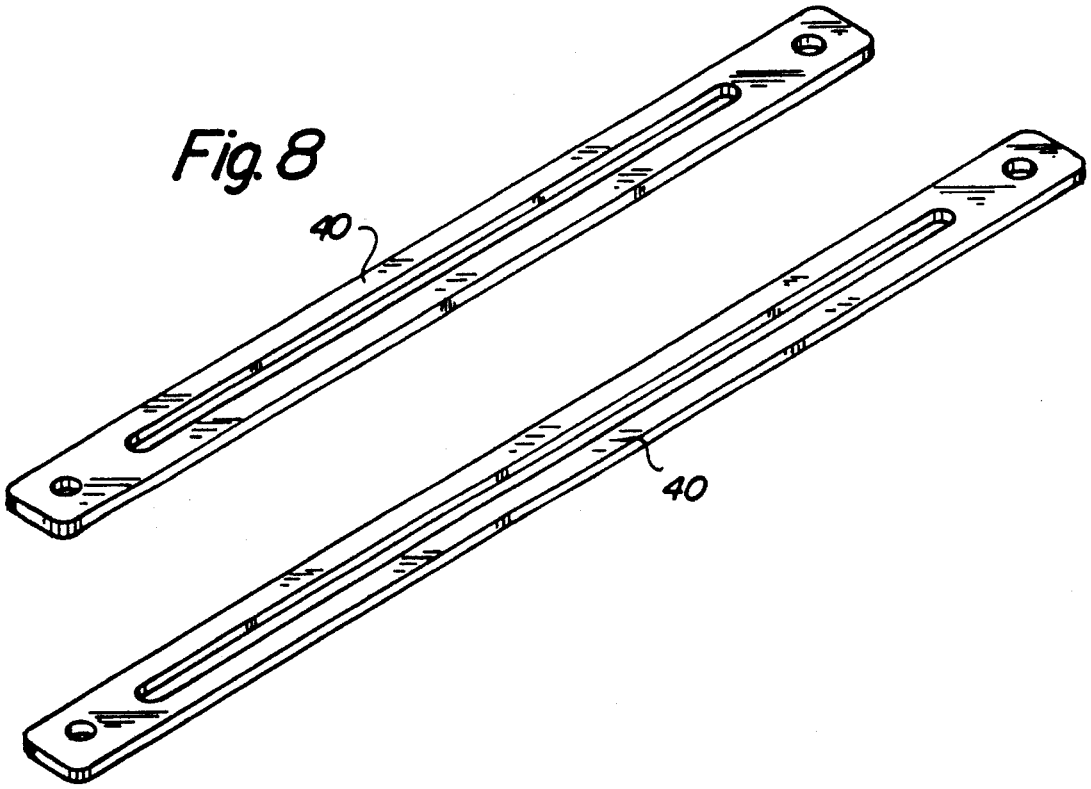
FIG. 8 is a perspective view of two of the potential sizes of elastic bands that can be employed.

With reference now to the drawings, and in particular, to FIG. 1 through 8 thereof, the preferred embodiment of the new and improved flex center embodying the principles and concepts of the present invention and generally designated by the reference number 10 will be described.

Specifically, it will be noted in the various Figures that the device relates to a new and improved flex center for exercising with the aid of rubber bands. In its broadest context, the device consists of a standing plate, two extension brackets, two lower L-shaped extensions, two U-shaped bar rest receivers, a foot bar, two elastic bands, and a shoulder bar.

The device 10 contains a standing plate 12 having a rectangular and flat configuration. The plate 12 has two side walls 14 and two base walls 16. The composition of the standing plate 12 should be of a rigid and light weight material that is durable yet light enough to be carried around and easily stored when not in use.

The device 10 contains two extension brackets 18. Each of the two brackets 18 has an upper end 20 and a lower end 22. The two brackets 18 are perpendicularly secured to the standing plate 12 with each of the two brackets 18 diametrically opposed and adjacent the two side walls 14 of the standing plate 12. Each of the two brackets 18 has a threaded aperture 24 therethrough. The shape of the brackets 18 is preferably triangular to minimize costs and also to minimize the amount of excess materials.

The device 10 contains two lower L-shaped extensions 26. Each extension 26 has a first end 28 and a second end 30. Each first end 28 is secured to the upper end 20 of the two extension brackets 18. The L-shaped extensions 26 should be made of a very rigid plastic and have a second end that is long enough so as to safely secure an elastic band without the risk of the band coming loose and causing injury.

The device 10 contains two U-shaped bar rest receivers 32. Each receiver 32 has an upper surface 34 and a lower surface 36. Each lower surface 36 is secured to the two lower L-shaped extensions 26.

A foot bar 38 is removably secured within the two threaded apertures 24 formed in the two extension brackets 18. The foot bar 38 is employed for the user to perform a greater variety of exercises that involve the user's feet remaining stationary.

The device 10 contains two elastic bands 40. Each band 40 has a first end 42 with an aperture, a second end 44 with an aperture, and an intermediate extent 46 therebetween with an oblong aperture therein. Each first end 42 is secured to a corresponding second end 30 of the two lower L-shaped extensions 26. The device 10 could be made to provide a variety of different sized elastic bands 40. The preferred length of the elastic bands would be four feet for performing squats and three feet and six inches for performing curls. The device is not limited to these particular sizes and could be provided for elastic bands suitable for men, women, and children.

The device 10 contains a shoulder bar 48 having a two off-set ends 50 and an intermediate extent 51 therebetween. Each of the two off-set ends 50 has an upper L-shaped extension 52 securely thereon. Each of the upper L-shaped extensions 52 is secured to the corresponding second end 44 of the two elastic bands 40. The two off-set ends 50 form handgrips. Alternately, rubber or foam handgrips could be employed for the device 10. A padded element 54 is secured to the intermediate extent 51. The padded element aides the user when doing exercises when the shoulder bar is placed directly on their shoulders, such as squats. The shoulder bar 48 is received in the upper surface 34 of the two U-shaped bar rest receivers 32 when not in use. The shoulder bar 48 enables the user to perform a great number of exercises including, but not limited to, curls, upright rows, bent over rows, low impact squats, military presses, back rows, and calf raises.

Many people are enthusiastically involved in physical fitness programs. Most neighborhood fitness facilities currently operate near their capacity to fill the needs of an energetic public. This situation has led to the popularity of home fitness machines which are convenient to use and considerably more accessible. Weight lifting, rowing, and cross-country skiing are just a few of the activities that can be emulated. But most good exercise machines are prohibitively expensive and consume a great deal of living space. This leaves few choices for shoppers searching for an affordable workout. That is why the present invention has been conceived. It is an inexpensive exercise machine that cleverly employs elastic bands to provide the necessary resistance, instead of free weights or hydraulics. The present invention is easy to use. It is more flexible in its employment than ordinary weight sets, and should be less expensive than television advertised machines.

The present invention consists of a standing plate, a shoulder bar, two sets of elastic bands. The standing plate provides the base from which the bands will be extended. It is flat with two extensions on the ends for attaching the bands. The shoulder bar is a steel padded rod that is bent slightly downward at the ends. In addition to the padded bar, the angled areas have dedicated handgrips. The bar is constructed with extensions to secure the bands, similar to the standing plate. The two sets of bands provided allow fully upright exercises, as well as those where the user is squatting or kneeling. The bands have holes in each end, and an elongated hole in the center. The size and profile of the various components allow this equipment to be easily stored in a small closet or even under a bed.

An almost infinite number of applications are possible. Exercises for when the body's limbs are moved in one plane only are as achievable as those where the bands are maneuvered in several different patterns. By using the many combinations, a complete low impact workout is derived. Few other exercise machines are as flexible or as inexpensive and easy to use. With these advantages, the present invention is almost certain to be appreciated by the millions of people who desire good hard exercise without the crowding and expense of fitness centers, and without the limitations of ordinary weight sets.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A flex center for exercising comprising, in combination:

a standing plate having a rectangular and flat configuration, the plate having two side walls and two base walls;

two extension brackets, each of the two brackets having an upper end and a lower end, the two brackets perpendicularly secured to the standing plate with each of the two brackets diametrically opposed adjacent the two side walls of the standing plate, each of the two brackets having a threaded aperture therethrough;

two lower L-shaped extensions, each extension having a first end and a second end, each first end secured to the upper end of the two extension brackets;

two U-shaped bar rest receivers, each receiver having an upper surface and a lower surface, each lower surface secured to the two lower L-shaped extensions;

a foot bar removably secured within the two threaded apertures of the two extension brackets;

two elastic bands, each band having a first end with an aperture, a second end with an aperture, and an intermediate extent therebetween with an oblong aperture therein, each first end secured to a corresponding second end of the two lower L-shaped extensions;

a shoulder bar having an intermediate extent therebetween and two ends off, set from the intermediate extent, each of the two off-set ends having an upper L-shaped extension securely thereon, each of the upper L-shaped extensions secured to the corresponding second end of the two elastic bands, the two off-set ends forming handgrips, a padded element secured to the intermediate extent, the shoulder bar received in the upper surface of the two U-shaped bar rest receivers when not in use.

* * * * *